US006086420A

United States Patent [19]

Wu

[11] Patent Number: 6,086,420

[45] Date of Patent: Jul. 11, 2000

[54] I/O PORT CONNECTOR

[75] Inventor: Kun-Tsan Wu, Tu-Chen, Taiwan

[73] Assignee: Hon Hai Precision Ind. Co., Ltd., Taiepi Hsien, Taiwan

[21] Appl. No.: 09/138,849

[22] Filed: Aug. 24, 1998

[30] Foreign Application Priority Data

Aug. 22, 1997 [TW] Taiwan ..... 86214395

[51] Int. Cl.[7] ..... H01R 13/648

[52] U.S. Cl. ..... 439/607; 439/620

[58] Field of Search ..... 439/607, 608, 439/609, 92, 95, 108, 676

[56] References Cited

U.S. PATENT DOCUMENTS

| | | | |
|---|---|---|---|
| 5,637,015 | 6/1997 | Tan et al. | 439/607 |
| 5,769,666 | 6/1998 | Wu | 439/620 |
| 5,797,770 | 8/1998 | Davis et al. | 439/607 |

*Primary Examiner*—Steven L. Stephan
*Assistant Examiner*—Eugene Byrd

[57] ABSTRACT

An I/O port connector having an EMI shield comprising a dielectric housing defining a receiving chamber with a front entrance and a rear opening. The housing defines a plurality of slits forming a plurality of flexible flaps therebetween, and further includes a bridge portion having a pair of supporting posts. The bridge portion defines a plurality of terminal receiving passages therein for receiving a corresponding number of terminals. A cantilever tongue extends from the bridge portion toward the front entrance and forms a terminal seat at a free end thereof. The EMI shield includes a first portion received within the chamber of the housing from the front entrance, a front entrance and a rear opening. The first portion is provided with at least a retaining strip for releasably retaining a mating connector, engaging tab and an aperture adjacent to the rear opening. A second portion is received within the chamber of the housing from the rear opening and includes vertically extending flaps forming projections thereon for releasably interlocking with the aperture of the engaging tab.

12 Claims, 6 Drawing Sheets

I/O PORT CONNECTOR

FIELD OF THE INVENTION

The present invention relates to a connector, and particularly to an I/O port connector having an EMI shield mounted within a dielectric housing thereof.

DESCRIPTION OF PRIOR ART

An I/O port connector is a robust connector electrically connected to a Universal Serial Bus circuit for interfacing signals between different peripherals and a host computer. The connector generally includes a dielectric housing having a plurality of terminals received therein and an EMI shield device is mounted suppressing noise induced from EMI.

The EMI shield can either enclose the housing as disclosed in Taiwan Utility Model Nos. 85201940, 85210941, and U.S. Pat. Nos. 5,017,156, 5,232,380, and 5,326,281; or the EMI shield can be disposed within the housing.

The former mounting arrangement is less economical since the entire surface area of the EMI shield is larger than that of the housing resulting in higher manufacturing cost. However, mounting the EMI shield within the housing may also raise problems. The EMI shield is attached to the housing by resilient retaining clips. If the thickness of the clip is too thin, a grasping force thereof acting on the housing becomes insufficient. If the thickness of each clipper is increased, an obstacle may be encountered while coupling with a mating connector.

SUMMARY OF THE INVENTION

An objective of the present invention is to provide an EMI shield for use with an I/O port connector having a dielectric housing, including a first portion and a second portion releasably interlocked with the first portion thereby facilitating assembly of the EMI shield within the housing of the connector.

Another objective of the present invention is to provide an EMI shield for use with an I/O port connector having a dielectric housing, wherein retaining strips of the EMI shield for gasping a housing of a mating connector are biased by a portion of the dielectric housing thereby reducing the thickness of the EMI shield and facilitating insertion and withdrawal of the mating connector.

In order to achieve the objectives set forth, an EMI shield for assembly within a dielectric housing of an I/O port connector in accordance with the present invention comprises a first portion, a front entrance and a rear opening. The portion is provided with at least a retaining strip for releasably retaining a mating connector thereof, and an engaging tab and an aperture adjacent to the rear opening. A second portion forms vertically extending flaps each having a projection for releasably interlocking with the retaining aperture of the engaging tab.

According to another embodiment in accordance with the present invention, an I/O port connector having an EMI shield comprises a dielectric housing defining a receiving chamber with a front entrance and a rear opening. The dielectric housing defines a plurality of slits forming a plurality of flexible flaps therebetween, and further includes a bridge portion having a pair of supporting posts. The bridge portion defines a plurality of terminal receiving passages therein for receiving a corresponding number of contacts. A cantilever tongue extends from the bridge portion toward the front entrance and forms a terminal seat at a free end thereof. The EMI shield includes a first portion received within the chamber of the housing from the front entrance, and a front entrance and a rear opening. The first portion is provided with at least a retaining strip for releasably retaining a mating connector, and an aperture adjacent to the rear opening. A second portion is received within the chamber of the housing from the rear opening and includes vertically extending flaps forming projections thereon for releasably interlocking with the aperture of the engaging tab.

These and additional objects, features, and advantages of the present invention will become apparent after reading the following detailed description of the preferred embodiment of the invention taken in conjunction with the appended drawing.

DETAILED DESCRIPTION OF THE PREFERRED EMBODIMENT

Figure 1:
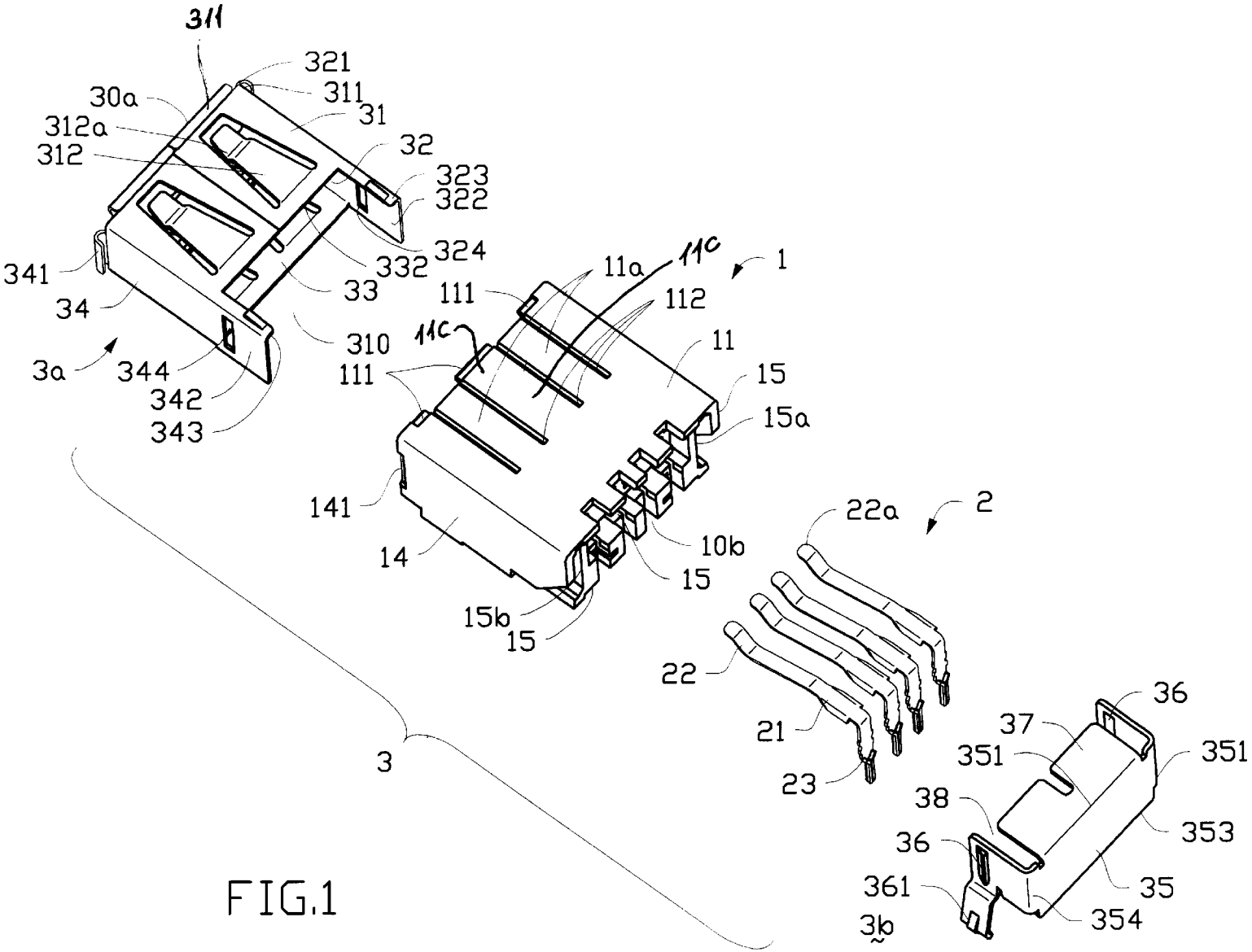
FIG. 1 is an exploded view of an I/O port connector in accordance with the present invention.
Figure 2:
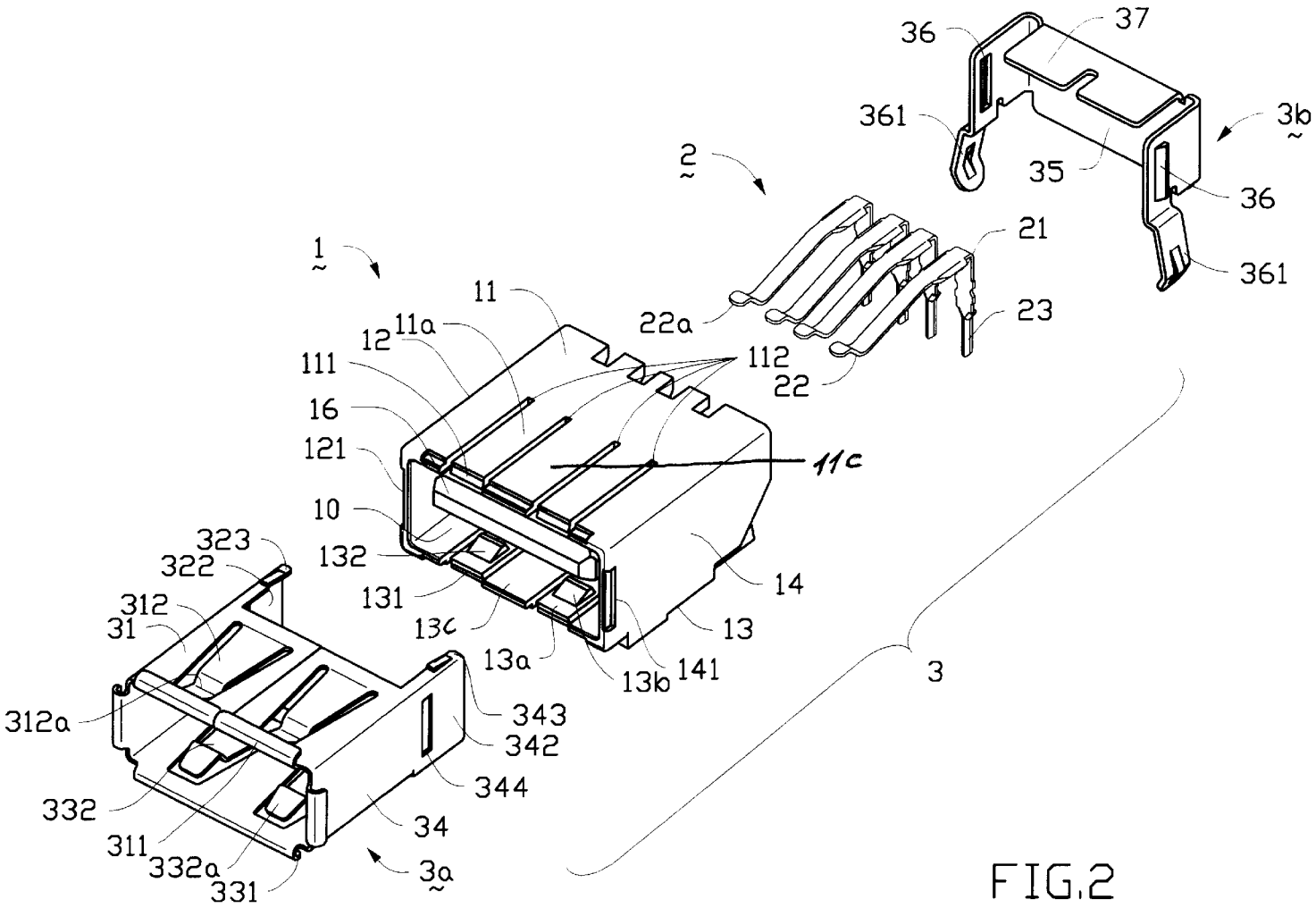
FIG. 2 is a front view of FIG. 1.

Referring to FIGS. 1 and 2, an I/O port connector in accordance with the present invention generally comprises a dielectric housing 1 in which plurality of terminals 2 are receive. An EMI shield 3 including a first portion 3*a* and a second portion 3*b* releasably interlocked with the first portion 3*a* is assembled to the housing 1.

The first portion 3*a* of the EMI shield 3 has a box-shaped configuration and defines first, second, third and fourth surfaces 31, 32, 33, and 34. The EMI shield 3 further defines a front entrance 30*a* and a rear opening 30*b*. Each surface 31, 32, 33, 34 is provided with a retaining clip 311, 321, 331, 341 adjacent to the front entrance 30*a*. Each first and third surface 31, 33 is provided with at least a retaining strip 312, 332 for releasably retaining a corresponding mating connector (not shown). Each retaining strip 312, 332 defines an angular end 312*a*, 332*a* projecting toward the front entrance 30*a*. Each second and fourth surface 32, 34 forms an engaging tab 322, 342 adjacent to the rear opening 30*b*. In order to enhance the rigidity of the engaging tab 322, 342, each engaging tab 322, 342 forms a fin portion 323, 343 integrally connected with the first surface 31. Each engaging tab 322, 342 further defines a rectangular aperture 324, 344 therein. A space 310 is defined between the engaging tabs 322, 342.

The second portion 3*b* includes a first planar portion 35 defining first, second, third and fourth sides 351, 352, 353, 354. Each of the second and fourth sides 352, 354 have a vertically extending flap 36 forming a projection 361 thereon for releasably interlocking with the aperture 324, 344 of the corresponding engaging tab 322. The first side 351 has a vertically extending plate 37 that occupies the space 310 between the engaging tabs 322, 342. Each flap 36 further forms a foot 361 for extending through a mounting hole of a printed circuit board (not shown). The flap 36 and the planar plate 37 further define a space 38 therebetween.

Figure 4:
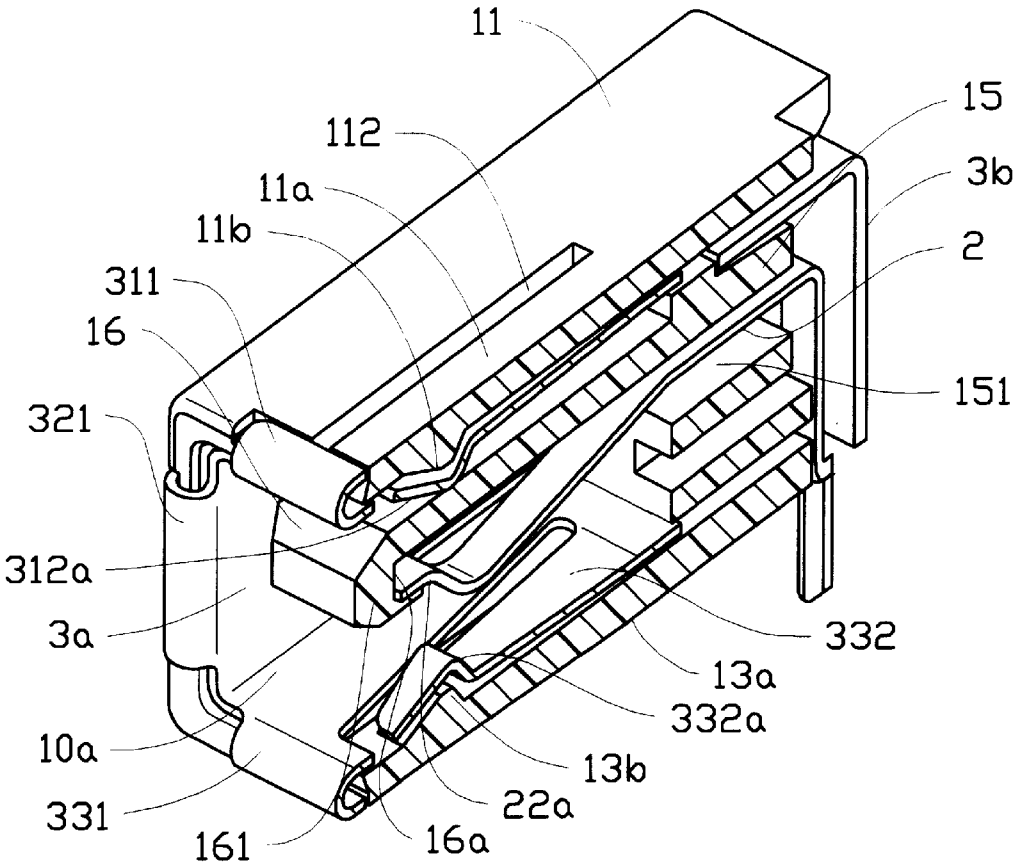
FIG. 4 is a perspective cross sectional view taken along line IV—IV of FIG. 3A.

The housing 1 has a box-shaped configuration defining a receiving chamber 10. The receiving chamber 10 forms a front entrance 10*a* for insertion of the first portion 3*a* of the EMI shield 3, and a rear opening 10*b* for insertion of the second portion 3*b* of the EMI shield 3. The housing defines first, second, third, and fourth surfaces 11, 12, 13, 14 each forming amount 111, 121, 131, 141 adjacent to the front entrance 10*a* for engagement with the corresponding retaining clip 311, 321, 331, 341 of the EMI shield 3. Each first and third surface 11, 13 defines a plurality of slits 112, 132 forming a plurality of flexible flaps 11*a*, 11*c*, 13*a*, and 13*c* therebetween. Referring to FIGS. 1 and 4, each flexible flap 11*a*, 13*a* further forms an embossment 11*b*, 13*b* in a position for providing support to the free end 312*a*, 332*a* of the retaining strip 312, 332 of the EMI shield 3. When the EMI shield 3 inserts into the receiving chamber 10, the retaining clips 311, 321, 331, and 341 engage with the corresponding mount 111, 121, 131, and 141, respectively. However, after the EMI shield 3 is seated, the middle flexible 11*c* and 13*c* are also engaged with the retaining clips 311 and 331 respectively, while the flexible 11*a* and 13*a* can move freely. This provides a special advantage that when the EMI shield 3 is seated, the retaining strips 312 and 332 are flexibly supported by the corresponding flaps 11*a* and 13*a*.

The housing 1 further includes a bridge portion 15 having a pair of supporting posts 15*a*, 15*b* attached to the third surface 13 of the housing 1. The bridge portion 15 defines a plurality of terminal receiving passage 151 therein. A cantilever tongue 16 extends from the bridge portion 15 toward the front entrance 10*a*, and forms a terminal seat 16*a* at a free end 161 thereof.

Each terminal 2 defines an interference portion 21 for engaging with a wall (not labeled) of the terminal receiving passage 151 thereby firmly retaining the terminal 2 in the housing 1. The terminal 2 further defines a contacting portion 22 having a free end 22*a* for electrically engaging with a mating pin (not shown), and a leg portion 23 for soldering to a corresponding conductive trace on a printed circuit board (not shown).

In assembly, the terminal 2 is inserted into the corresponding terminal receiving passage 151 and the free end 22*a* is seated on the terminal seat 16*a*. The first and second portion 3*a*, 3*b* of the EMI shield 3 are then received within the chamber 10 of the housing I from the front and rear openings 10*a*, 10*b* thereof, respectively. The second portion 3*b* is interlocked with the first portion 3*a* by means of the engagement between the apertures 324, 344 and the projections 361. In addition, each retaining clipper 311, 321, 331, 341 is seated on the corresponding mount 111, 121, 131, 141 thereby accurately positioning the first portion 3*a* within the chamber 10.

Figure 3A:
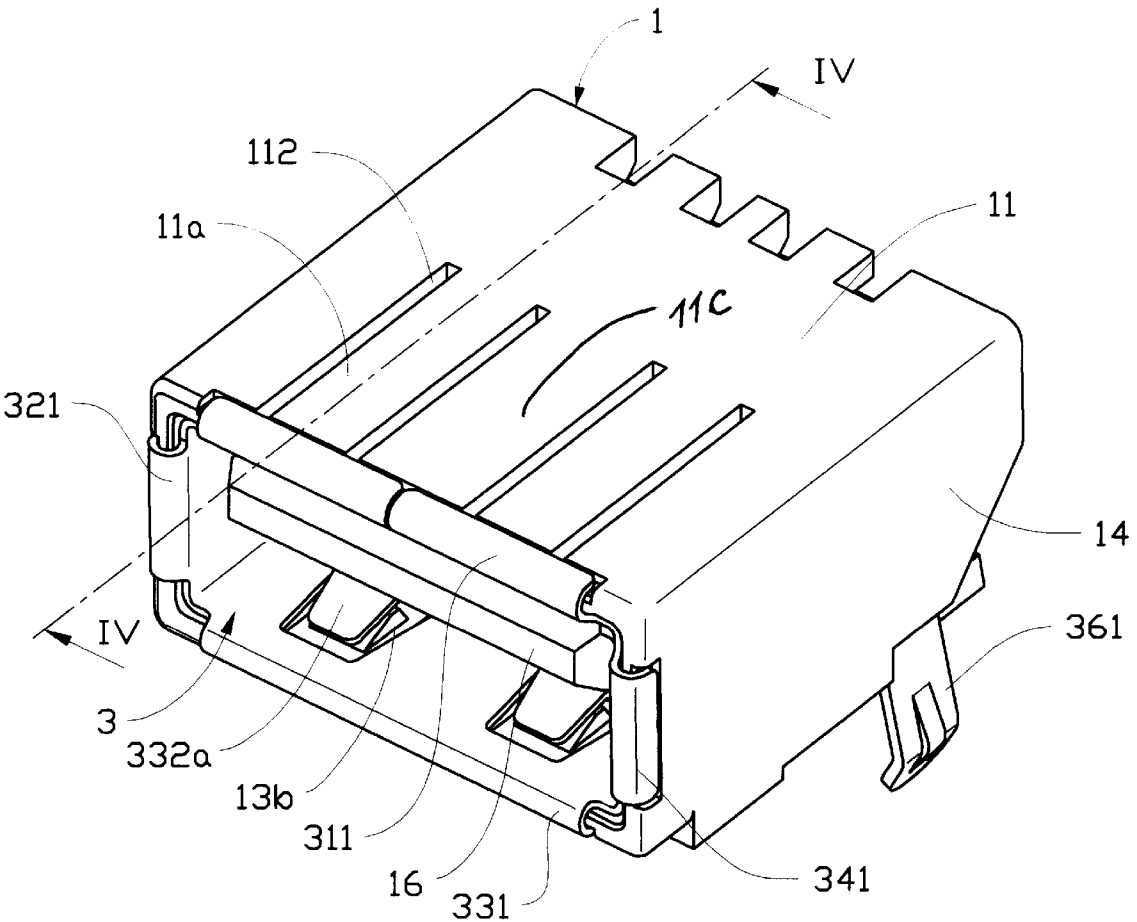
FIG. 3A is a perspective view of the assembled I/O port connector.
Figure 3B:
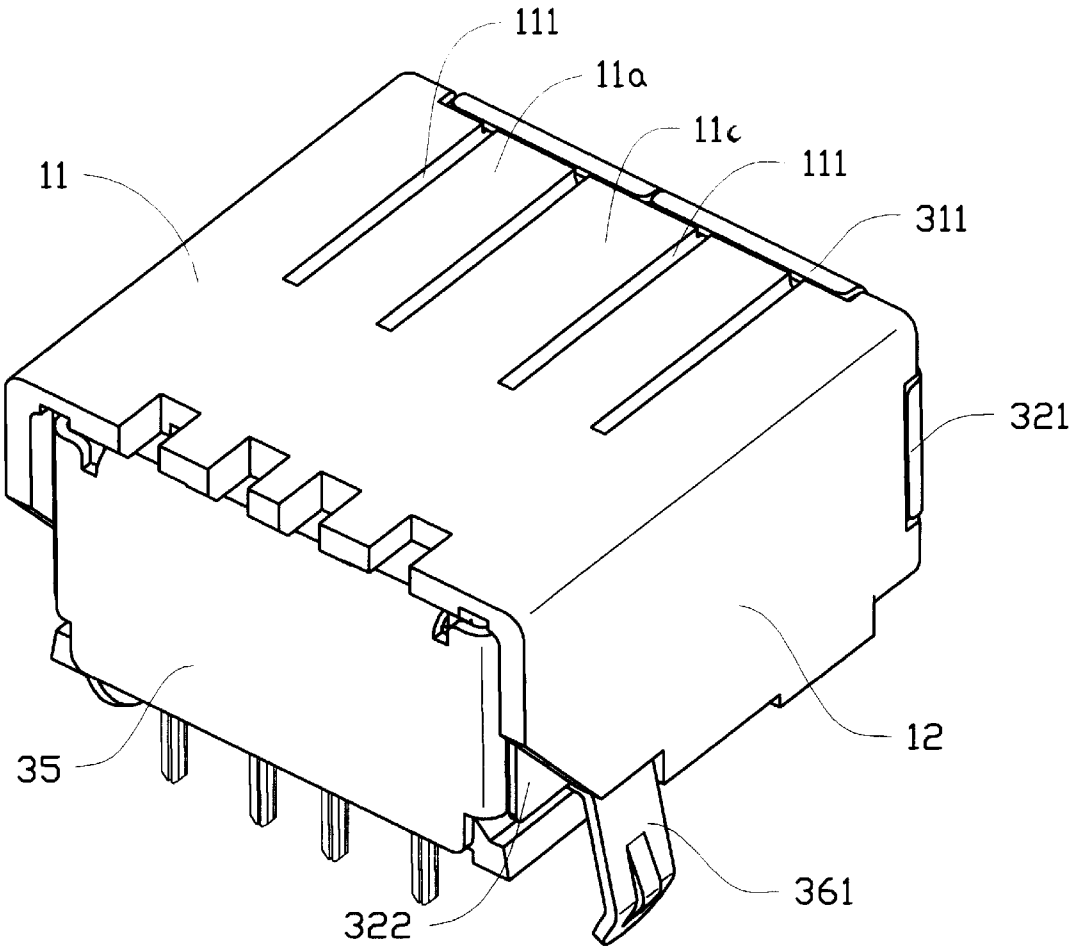
FIG. 3B is a rear view of FIG. 3A.

The embossments 11*b* of the housing 1 provide a firm backup to the angular ends 312*a* of the retaining strips 312. By this arrangement, the thickness of the EMI shield 1 is reduced which lowers manufacturing costs while maintaining the grasping force thereof. The second portion 3*b* is received in the rear opening 10*b* of the housing 1 thereby shielding the entire rear opening 10*b*. Accordingly, assembled the I/O port connector shown in FIGS. 3A and 3B achieves complete EMI shield.

Figure 5:
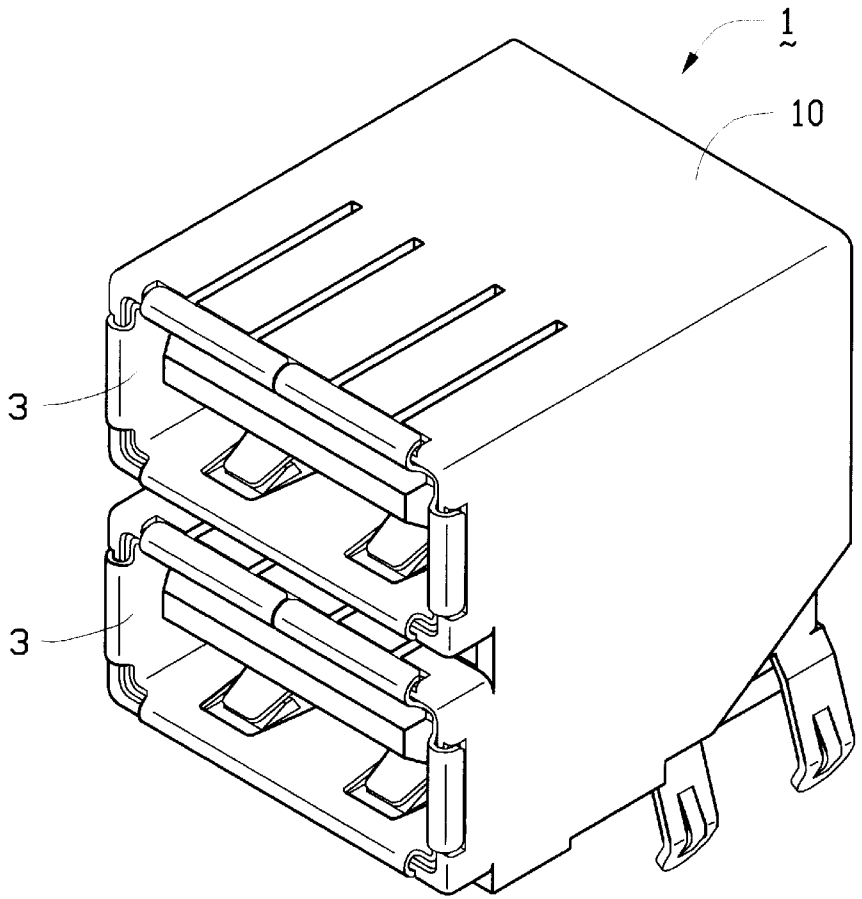
FIG. 5 is an alternative embodiment of the present invention in which two I/O port connectors are stacked together.

Referring to FIG. 5, an alternative embodiment of the present invention in which two I/O port connectors are stacked together is shown. In this case, a pair of EMI shields is each attached within a corresponding chamber of said stacked connectors.

While the present invention has been described with reference to specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

I claim:

1. An I/O port connector having an EMI shield, comprising:

a dielectric housing defining a receiving chamber having a front entrance and a rear opening, said housing defining first, second, third, and fourth surfaces, at least one of said first and third surfaces defining at least two slits forming a flexible flaps therebetween, said housing including a plurality of terminal receiving passages therein;

a plurality of terminals each being received within said corresponding terminal receiving passage; and an EMI shield, including a first portion being received within said chamber of said housing from said front entrance and defining first, second, third and fourth surfaces, and a front entrance and a rear opening, one of said first and third surfaces being provided with at least a retaining strip for releasably retaining a mating connector, said retaining strip being flexibly supported by said flexible flap of said housing, at least one of said second and fourth surfaces forming an engaging tab and an aperture adjacent to said rear opening; and a second portion being received within said chamber of said housing from said rear opening and including a first planar portion defining first, second, third and fourth sides, at least one of said second and fourth sides having a vertically extending flap forming a projection thereon for releasably interlocking with said retaining aperture of said engaging tab.

2. An I/O port connector as recited in claim 1, wherein each surface of said first portion is provided with a retaining clip adjacent to said front entrance.

3. An I/O port connector as recited in claim 1, wherein said retaining strip forms an angular end projecting toward said front entrance.

4. An I/O port connector as recited in claim 1, wherein each flap further forms a foot extending through a mounting hole of a printed circuit board.

5. An I/O port connector as recited in claim 1, wherein each said engaging tab forms a fin portion integrally connected with said first surface of said first portion.

6. An I/O port connector as recited in claim 1, wherein each said surface of said housing forms a mount adjacent to the front entrance for engagement with a corresponding retaining clip.

7. An I/O port connector as recited in claim 1, wherein each said first and second surface defines plurality of slits forming a plurality of flexible flaps therebetween.

8. An I/O port connector as recited in claim 7, wherein each said flexible flap forms an embossment for providing support to a free end of said retaining strip when said first portion is received in said housing.

9. An I/O port connector having an EMI shield, comprising:

a dielectric housing defining a receiving chamber, said housing integrally forming at least a flexible flap thereof facing to said chamber; and an EMI shield being received within said chamber of said housing, said shield forming at least a retaining strip for releasably retaining a mating connector, a portion of said retaining strip being supportably and outward deflectably moved along with said flexible flap of said housing when the I/O port connector engages the mating connector.

10. An I/O port connector as recited in claim 9, wherein said flexible flap is formed between a pair of slits in the housing.

11. An I/O port connector as recited in claim 9, wherein said flexible flap forms an embossment thereof.

12. An I/O port connector as recited in claim 9, wherein said retaining strip forms an angular end suitably being biased by said embossment.

* * * * *